US008698699B2

(12) United States Patent
Saarela et al.

(10) Patent No.: US 8,698,699 B2
(45) Date of Patent: Apr. 15, 2014

(54) CONNECTOR

(75) Inventors: Timo Saarela, Tampere (FI); Janne Kantola, Lempaala (FI)

(73) Assignee: Nokia Corporation, Espoo (FI)

( * ) Notice: Subject to any disclaimer, the term of this patent is extended or adjusted under 35 U.S.C. 154(b) by 1045 days.

(21) Appl. No.: 12/520,623

(22) PCT Filed: Dec. 21, 2006

(86) PCT No.: PCT/EP2006/012638
§ 371 (c)(1),
(2), (4) Date: Apr. 5, 2010

(87) PCT Pub. No.: WO2008/074357
PCT Pub. Date: Jun. 26, 2008

(65) Prior Publication Data

US 2010/0201602 A1 Aug. 12, 2010

(51) Int. Cl.
*H01Q 1/00* (2006.01)

(52) U.S. Cl.
USPC ..... 343/906

(58) Field of Classification Search
USPC ..... 343/904, 905, 906, 720; 439/349, 669, 439/578, 625, 626, 660, 668, 916
See application file for complete search history.

(56) References Cited

U.S. PATENT DOCUMENTS

| | | | | |
|---|---|---|---|---|
| 5,158,465 | A * | 10/1992 | Zaderej et al. | 439/55 |
| 5,195,904 | A * | 3/1993 | Cyvoct | 439/349 |
| 2003/0228791 | A1 * | 12/2003 | Milan | 439/502 |
| 2004/0067684 | A1 * | 4/2004 | Mueller et al. | 439/578 |

FOREIGN PATENT DOCUMENTS

| | | | |
|---|---|---|---|
| DE | 20307156 | U1 | 9/2003 |
| EP | 0491626 | A1 | 6/1992 |

OTHER PUBLICATIONS

International Search Report and Written Opinion of the International Searching Authority for PCT Application No. PCT/EP2006/012638, dated Jun. 20, 2007, 10 pages.

* cited by examiner

*Primary Examiner* — Robert Karacsony
(74) *Attorney, Agent, or Firm* — Nokia Corporation

(57) ABSTRACT

A connector comprising a contact arranged to mate with a contact of a corresponding connector, the contact providing a contact point of a first signal path for the transmission of electrical signals through the connector; an electrically-conductive element arranged to engage an electrically-conductive element on the corresponding connector, the electrically conductive-element providing a contact point of a second signal path for the transmission of electrical signals through the connector, wherein the electrically-conductive element comprises one or more of a region of a housing for holding the connector, a region of a locking element, two or more regions of a barrel with an internal connection path aperture, and a region of the contact electrically isolated from a main contact region.

20 Claims, 10 Drawing Sheets

CONNECTOR

RELATED APPLICATION

This application was originally filed as and claims priority to PCT Application No. PCT/EP2006/012638.

This invention relates to a connector and a method of using the connector.

BACKGROUND

An FM radio antenna may be implemented by using a headset cable. The FM radio engine itself may be in the baseband area of a mobile device, with the antenna (the headset cable) connecting to the baseband area through a system port. A proprietary connector solution or a standard (e.g. 2.5/3.5 mm) audio plug may be used to connect the headset to the system port.

The listing or discussion of a prior-published document in this specification should not necessarily be taken as an acknowledgement that the document is part of the state of the art or is common general knowledge.

SUMMARY

According to a first aspect, there is provided a connector comprising a contact arranged to mate with a contact of a corresponding connector, the contact providing a contact point of a first signal path for the transmission of electrical signals through the connector;

an electrically-conductive element arranged to engage an electrically-conductive element on the corresponding connector, the electrically conductive-element providing a contact point of a second signal path for the transmission of electrical signals through the connector, wherein the electrically-conductive element comprises one or more of a region of a housing for holding the connector, a region of a locking element, two or more regions of a barrel with an internal connection path aperture, and a region of the contact electrically isolated from a main contact region.

The electrically-conductive element may be a region of a locking element, the locking element comprising one of a protrusion or a recessed part and being arranged to engage the other of the protrusion or recessed part on the corresponding connector.

The connector may comprise a conductor in electrical communication with the electrically-conductive element.

The conductor may be arranged to act as a radio antenna.

The connector may comprise a cable having one or more wires connected to the contact, the cable comprising a shield enclosing the one or more wires, the conductor being at least partially external to the shield.

The connector may comprise a conductor in electrical communication with the electrically-conductive element, the conductor being arranged for connection of the second signal path to a device associated with the connector.

The connector may comprise a plurality of electrically-conductive elements arranged to engage electrically-conductive elements on the corresponding connector, each electrically conductive-element providing a contact point of a respective signal path for the transmission of electrical signals through the connector, wherein each electrically-conductive element comprises one or more of a region of a housing, a region of a locking element, and a region of the contact electrically isolated from a main contact region.

The connector comprising the plurality of electrically-conductive elements may comprise any of the above-described features.

The connector may be a male connector.

The connector may be a female connector.

The connector may be arranged to conform to a universal serial bus (USB) standard, for example the USB 2.0 specification, and in particular the On-The-Go Supplement to the USB 2.0 specification, especially revision 1.2.

The connector may be arranged to conform to an audio jack standard.

The connector may be arranged to provide power to an electronic device.

According to a second aspect, there is provided an electronic device comprising the connector of the first aspect.

According to a third aspect, there is provided a peripheral device comprising the connector of the first aspect.

According to a fourth aspect, there is provided a method of using a connector, the connector comprising a contact arranged to mate with a contact of a corresponding connector, the contact providing a contact point of a first signal path for the transmission of electrical signals through the connector;

an electrically-conductive element arranged to engage an electrically-conductive element on the corresponding connector, wherein the electrically-conductive element is one or more of a region of a housing for holding the connector, a region of a locking element, two or more regions of a barrel with an internal connection path aperture, and a region of the contact electrically isolated from a main contact region; wherein the method comprises using the electrically conductive-element to provide a contact point of a second signal path for the transmission of electrical signals through the connector.

According to a fifth aspect, there is provided a connector comprising means for contacting arranged to mate with means for contacting on a corresponding connector, the means for contacting providing a contact point of a first signal path for the transmission of electrical signals through the connector;

a means for electrically conducting arranged to engage a means for electrically conducting on the corresponding connector, the means for electrically conducting providing a contact point of a second signal path for the transmission of electrical signals through the connector, wherein the means for electrically conducting comprises one or more of a region of a housing for holding the connector, a region of a locking element, two or more regions of a barrel with an internal connection path aperture, and a region of the contact electrically isolated from a main contact region.

According to a sixth aspect, there is provided a method of using a connector, the connector comprising means for contacting arranged to mate with means for contacting on a corresponding connector, the means for contacting providing a contact point of a first signal path for the transmission of electrical signals through the connector;

a means for electrically conducting arranged to engage a means for electrically conducting on the corresponding connector, wherein the means for electrically conducting comprises one or more of a region of a housing for holding the connector, a region of a locking element, two or more regions of a barrel with an internal connection path aperture, and a region of the contact electrically isolated from a main contact region; wherein the method comprises a step for using the means for electrically conducting to provide a contact point of a second signal path for the transmission of electrical signals through the connector.

According to a seventh aspect, there is provided a connector comprising a contact arranged to mate with a contact of a corresponding connector, the contact providing a contact point of a first signal path for the transmission of electrical signals through the connector;

an electrically-conductive element arranged to engage an electrically-conductive element on the corresponding connector, the electrically conductive-element providing a contact point of a second signal path for the transmission of electrical signals through the connector, wherein the electrically-conductive element on the corresponding connector comprises one or more of a region of a housing for holding the connector, a region of a locking element, two or more regions of a barrel with an internal connection path aperture, and a region of the contact electrically isolated from a main contact region.

According to an eighth aspect, there is provided a connector comprising a contact arranged to mate with a contact of a corresponding connector, the contact providing a contact point of a first signal path for the transmission of electrical signals through the connector;

an electrically-conductive element arranged to engage an electrically-conductive element on the corresponding connector, the electrically conductive-element providing a contact point of a second signal path for the transmission of electrical signals through the connector, wherein the electrically-conductive element has a primary function other than that of a contact.

The primary function may be that of a locking element.

The primary function may be that of a housing.

According to a ninth aspect, there is provided a connector comprising a contact arranged to mate with a contact of a corresponding connector, the contact providing a contact point of a first signal path for the transmission of electrical signals through the connector;

an electrically-conductive element arranged to engage an electrically-conductive element on the corresponding connector, the electrically conductive-element providing a contact point of a second signal path for the transmission of electrical signals through the connector, wherein the electrically-conductive element on the corresponding connector has a primary function other than that of a contact.

The present invention includes one or more aspects, embodiments or features in isolation or in various combinations whether or not specifically stated (including claimed) in that combination or in isolation.

The above summary is intended to be merely exemplary and non-limiting.

BRIEF DESCRIPTION OF THE DRAWINGS

A description is now given, by way of example only, with reference to the accompanying drawings, in which.

DETAILED DESCRIPTION

Figure 1:
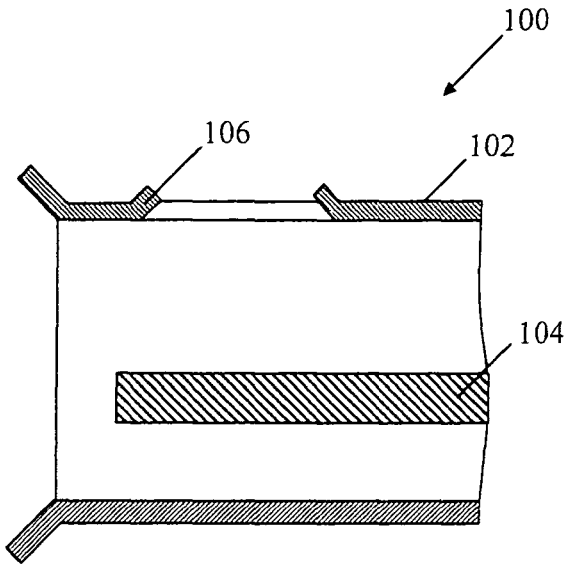
FIG. 1 is a cross section of a first embodiment of a female connector.
Figure 4:
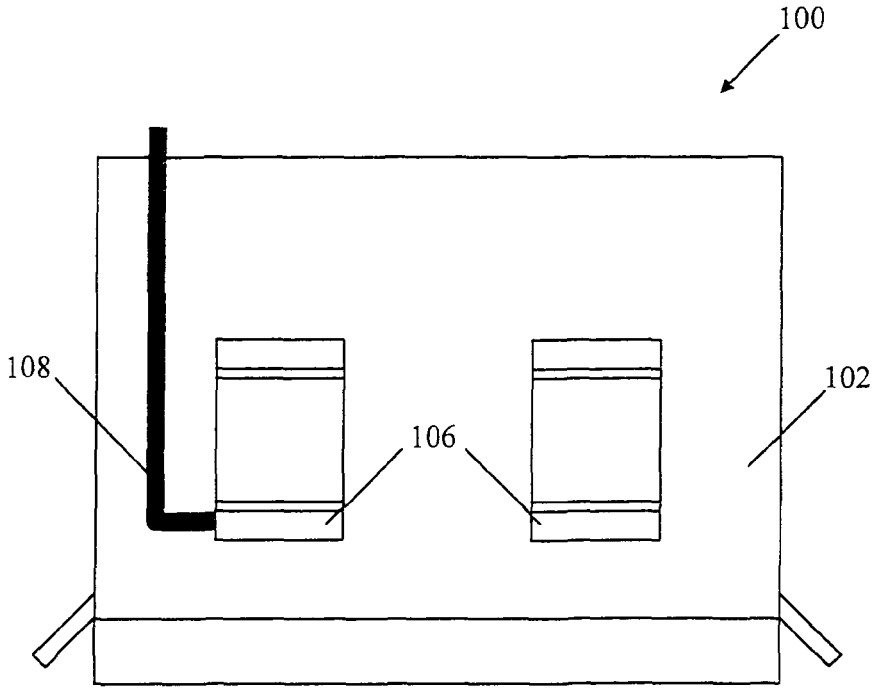
FIG. 4 is plan view of the female connector of FIG. 1.

FIGS. 1 and 4 show a female connector 100. The connector 100 comprises a housing 102 partially surrounding contacts 104 (only one of which is shown in FIG. 1) arranged to mate with the contacts 204 of a corresponding male connector 200 (shown in FIG. 2) to provide a user-releasable connection of the connectors 100, 200. Each contact 104 provides a contact point for a respective first signal path for the transmission of electrical signals through the connector 100.

The outwardly facing surface of the housing 102 is generally non-conductive so that it can be held by a user without getting an electric shock when the female connector 100 is inserted around and/or connected to a corresponding male connector.

Figure 3:
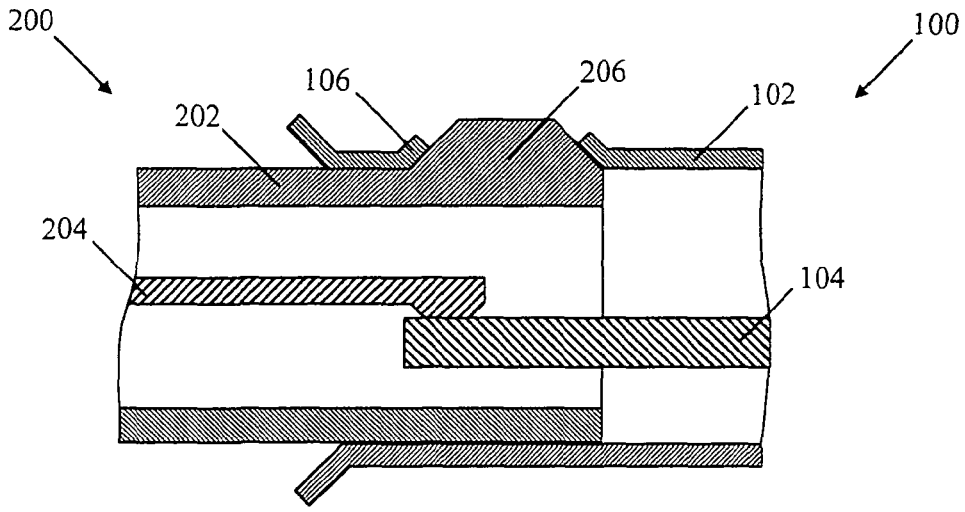
FIG. 3 is a cross section of the female connector of FIG. 1 connected to the male connector of FIG. 2.

The connector 100 includes a locking element 106 being separate to the contacts 104 and arranged to engage a locking element 206 of the corresponding male connector 200 in order to releasably lock the connectors 100, 200 together. The locking element 106 comprises a recessed part (which may or may not be a through thickness aperture, e.g. a dimple) and is arranged to be engaged by a protrusion 206 on the male connector 200. The locking element 106 is metallic and is therefore electrically conductive. The locking element 106 is arranged to form an electrical connection with the locking element 206 of the corresponding male connector 200 when the two locking elements 106, 206 engage. The locking element 106 provides a contact point of a second signal path for the transmission of electrical signals through the female connector 100 (FIG. 3). The second signal path may be a ground line.

As shown in FIG. 4, the female connector 100 includes a conductor 108 extending from the locking element 106. The conductor 108 and the locking element 106 cooperate to provide the second signal path for the transmission of electrical signals through the female connector 100. The contact perimeter of the locking element 106 is metallic, and surrounded by an insulating material (e.g. plastic). Part or all of conductor 108 may be embedded within the insulating material. The locking element 106 may be a conductive insert placed in an aperture in the body of the female connector 100.

The outwardly facing surface of the female connector 100 may be covered by a permanent/user-removable insulating layer, e.g. a plastic sheath. In one embodiment, electrical isolation between adjacent locking elements 106 may be provided by separating the adjacent locking elements 106 using an insulating material.

Figure 2:
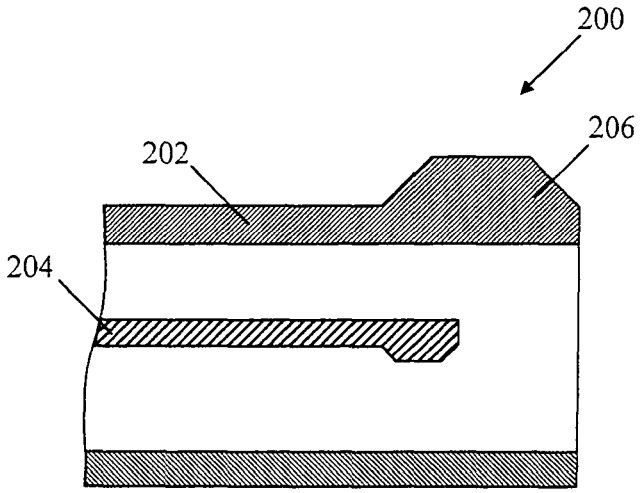
FIG. 2 is a cross section of a first embodiment of a male connector.
Figure 5:
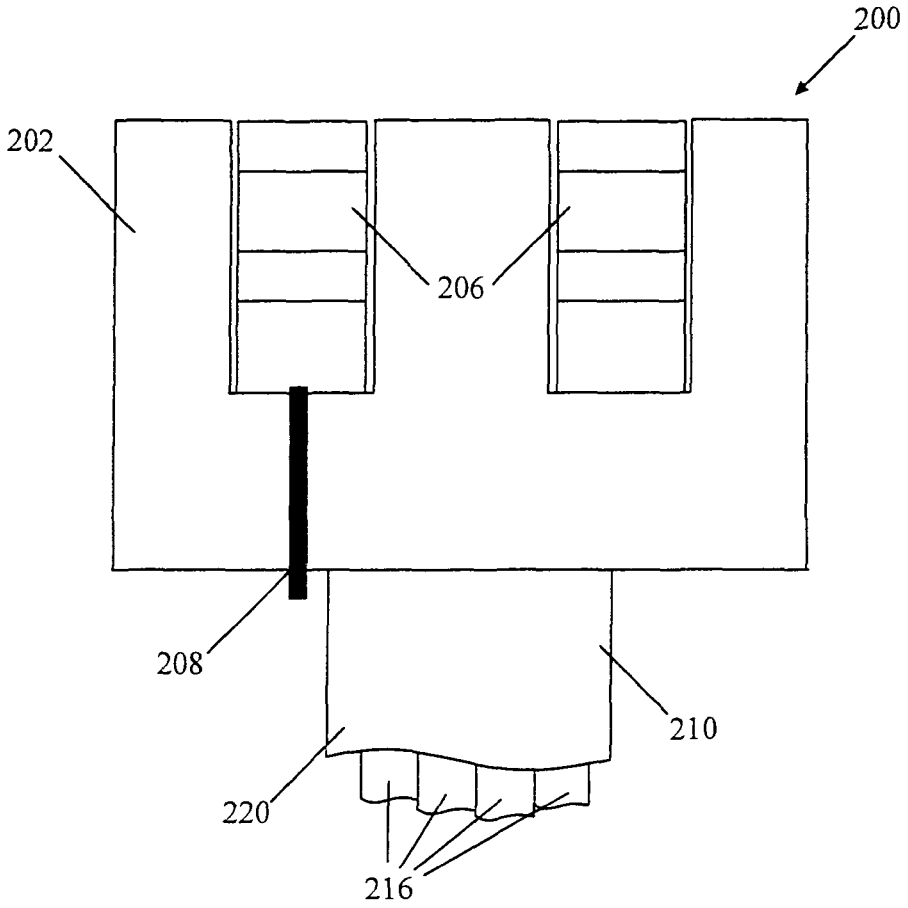
FIG. 5 is a plan view of the male connector of FIG. 2.

FIGS. 2 and 5 show the male connector 200. The male connector 200 comprises a housing 202 (generally non-conductive outwardly facing surface so that it can be held without electric shock) partially surrounding contacts 204 (only one of which is shown in FIG. 2) arranged to mate with the contacts 104 of the female connector 100 of FIG. 1. Each contact 204 provides a contact point for a respective first signal path for the transmission of electrical signals through the male connector 200.

The male connector 200 includes a locking element 206 being separate to the contacts 204 and arranged to engage the locking element 106 of the female connector 100 to releasably lock the connectors 100, 200 together. The locking element 206 comprises a protrusion 206 and is arranged to engage the recessed part on the female connector 100. The locking element 206 is metallic and is therefore electrically conductive. The locking element 206 is arranged to form an electrical connection with the locking element 106 of the female connector 100 when the two locking elements 106, 206 engage. The locking element 206 provides a contact point of a second signal path for the transmission of electrical signals through the male connector 200.

As shown in FIG. 5, the male connector 200 includes a conductor 208 extending from the locking element 206. The conductor 208 and the locking element 206 cooperate to provide the second signal path for the transmission of electrical signals through the male connector 200.

In one embodiment, the conductor 208 forms part of a first wire 208, which is thus in electrical communication with the locking element 206. In one embodiment, the first wire 208 is arranged to act as a radio antenna. In this way, the connector 200 can be used in relation both to digital signals using the contacts 204 and analogue (e.g. FM) signals using the first wire 208. In another embodiment, the conductor 208 is arranged for connection of the second signal path to a device associated with the male connector 200, in order to provide an additional path for signals similar to those transmitted using the contacts 204.

The male connector 200 comprises a cable 210 having a plurality of second wires 216 connected to respective contacts 204 of the connector 200. The cable 210 comprises a shield 220 enclosing the second wires 216. The first wire 208 is external to the shield 220.

Similar to an embodiment of the female connector 100, part or all of the conductor 208 may be embedded within an insulating material comprising the housing of the male connector 200.

Figure 6:
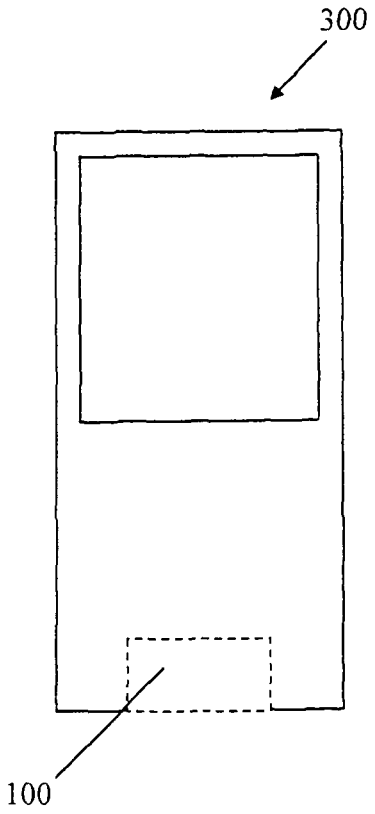
FIG. 6 is a schematic diagram of an electronic device including the female connector of FIG. 1.

FIG. 6 shows an electronic device 300 comprising the female connector 100 of FIG. 1. In this case, the device 300 is a handportable multimedia device. The device 300 may or may not comprise radiotelephony functionality.

Figure 7:
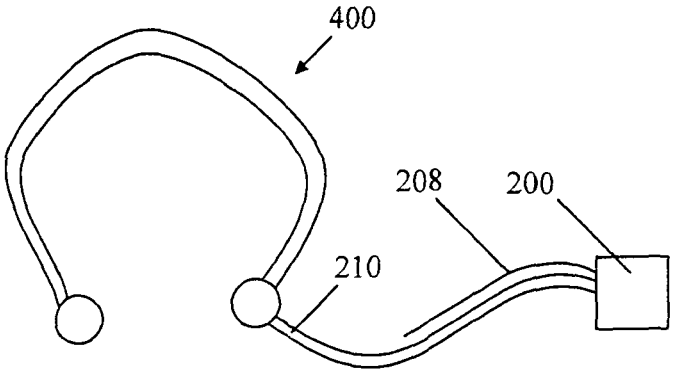
FIG. 7 is a schematic diagram of a peripheral device including the male connector of FIG. 2.

FIG. 7 shows a peripheral device 400 comprising the male connector 200 of FIG. 2. In this case, the device 400 is a headset for transmitting audio to a user.

Figure 8:
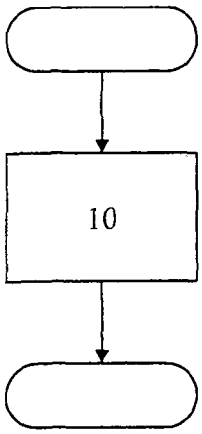
FIG. 8 is a flowchart representing a method of using the female connector of FIG. 1 or the male connector of FIG. 2.

FIG. 8 is a flowchart representing a method of using a connector 100, 200. The method includes the step (10) of using an electrically conductive-element (for example a locking element 106, 206) to provide a contact point of a second signal path for the transmission of electrical signals through the connector 100, 200, the second signal path being separate to one or more first signal paths provided by contacts 104, 204 of the connector 100, 200.

Figure 9:
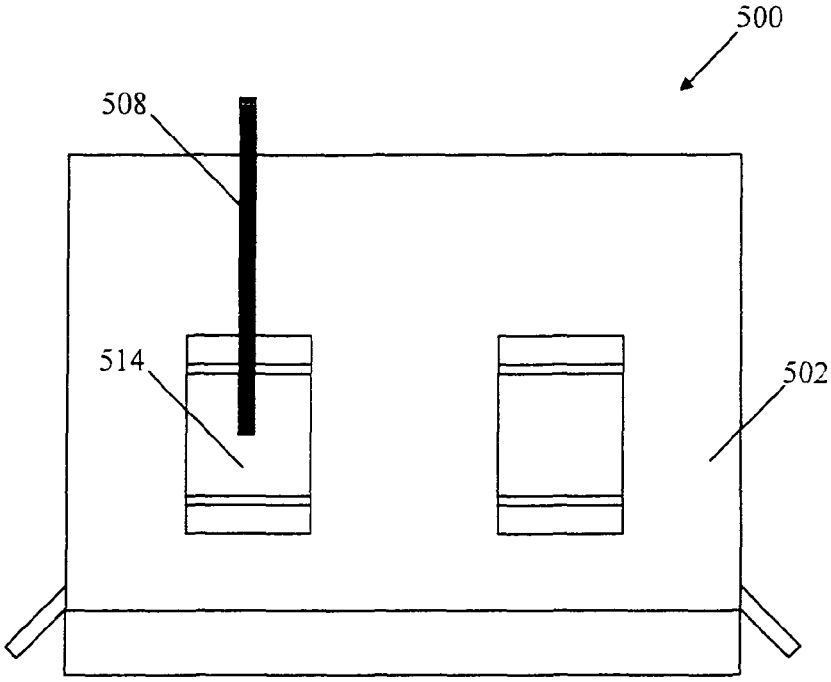
FIG. 9 is plan view of a second embodiment of a female connector.
Figure 10:
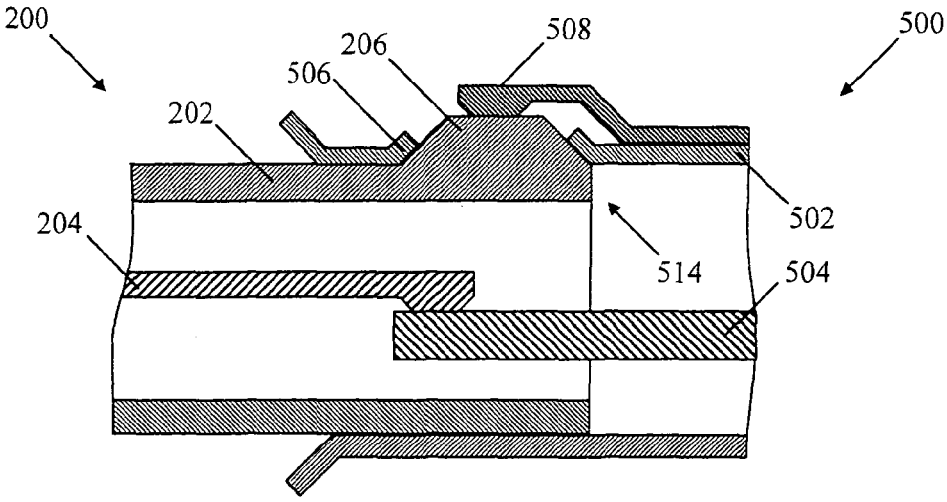
FIG. 10 is a cross section of the female connector of FIG. 1.

FIGS. 9 and 10 show a second embodiment of a female connector 500. The female connector 500 is identical to the female connector 100 of FIG. 1 except that, in the female connector 500, the conductor 508 is arranged to electrically connect directly to the locking element 206 of the male connector 200. In this embodiment, there is no need for the recessed part of the locking element 506 of the female connector 500 to be electrically conductive, or for it to form an electrical connection with the locking element 206 of the male connector 200. As shown in FIGS. 9 and 10 an electrical contact point 514 is formed between the locking element 206 of the male connector 200 and the conductor 508 of the female connector 500 to provide the second signal path for the transmission of electrical signals through the female connector 500.

Figure 11:
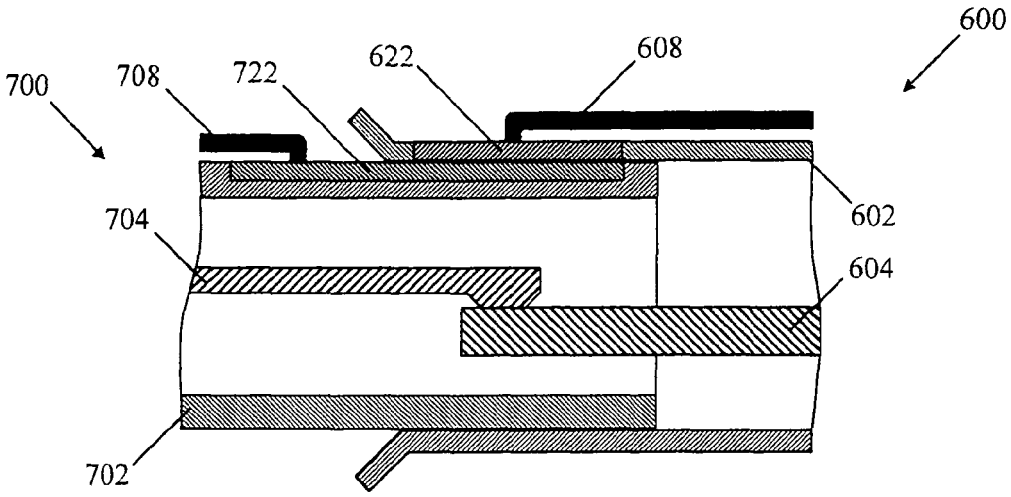
FIG. 11 shows a third embodiment of a female connector connected to a third embodiment of a male connector.

FIG. 11 shows a third embodiment of a female connector 600 connected to a third embodiment of a male connector 700. The connectors 600, 700 may or may not include the locking elements 106, 206 as before, but these are not shown for reasons of clarity. The female connector 600 includes a pad 622 formed in the housing 602 to which (i.e. pad 622) a conductor 608 is electrically connected. The male connector 700 includes a pad 722 formed in the housing 702 to which pad 722 a conductor 708 is electrically connected. When the male and female connectors 700, 600 are connected, the pads 622, 722 are in electrical contact. Each pad 622, 722 thus provides a point of contact for a second signal path through its respective connector 600, 700, in addition to first signal paths provided by the contacts 604, 704.

Figure 12:
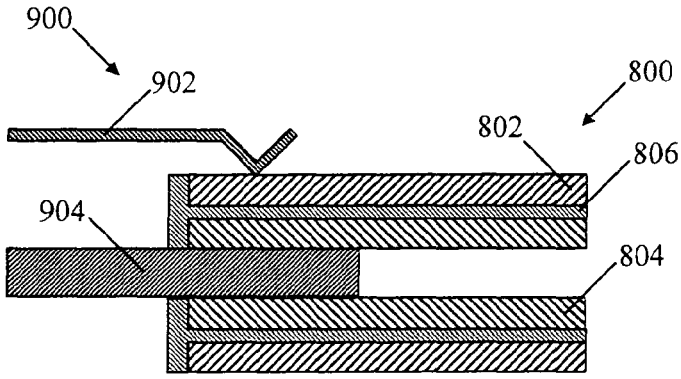
FIG. 12 is a cross section of a fourth embodiment of a male connector connected to a fourth embodiment of a female connector.

FIG. 12 is a cross section of a DC barrel jack 800 connected to a socket 900. The barrel jack 800 includes an outer barrel contact 802 and an inner barrel contact 804. The barrel contacts 802, 804 are electrically insulated from one another by insulating material 806. The socket 900 includes a spring contact 902 arranged to electrically connect to the outer barrel contact 802 of the barrel jack 800, and a pole 904 arranged to electrically connect to the inner barrel contact 804 via an internal aperture in the barrel 800. Such a barrel jack may be used, for example, to provide power to an electronic device via contacts 804, 904 and provide connection of an (e.g. FM) antenna using contacts 802, 902.

Figure 13:
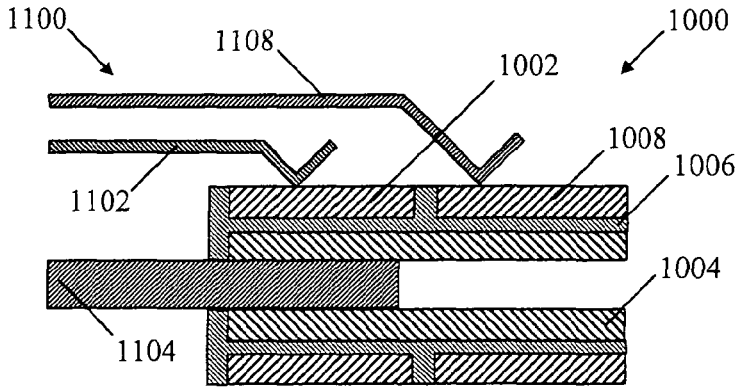
FIG. 13 is a cross section of a fifth embodiment of a male connector connected to a fifth embodiment of a female connector.

FIG. 13 shows a cross section of a DC barrel jack 1000 connected to a socket 1100. The barrel jack 1000 includes a first outer barrel contact 1002, a second outer barrel contact 1008 and an inner barrel contact 1004. The first outer barrel contact 1002 and the inner barrel contact 1004 are main contact regions, an internal aperture allowing access to the contact 1004. The barrel contacts 1002, 1004, 1008 are electrically insulated from one another by insulating material 1006. In a different embodiment (not shown), the barrel contacts 1002, 1008 may be internal barrel contacts providing connection through the internal barrel aperture. In such an embodiment, the corresponding socket 1100 would have independent signal paths for each of the internal barrel contacts.

The socket 1100 includes a first spring contact 1102 arranged to electrically connect to the first outer barrel contact 1002 of the barrel jack 1000, a second spring contact 1108 arranged to electrically connect to the second outer barrel contact 1008 of the barrel jack 1000, and a pole 1104 arranged to electrically connect to the inner barrel contact 1004. The second outer barrel contact 1008 and the second spring contact 1108 provide contact points of a second signal path for the transmission of electrical signals through the respective connector 1000, 1100, in addition to first signal paths provided by the first outer barrel contact 1002/first spring contact 1102 and the inner barrel contact 1004/pole 1104. Such a barrel jack may be used, for example, to provide power to an electronic device via contacts 1002, 1102 and 1004, 1104 and to provide connection of an (e.g. FM) antenna using contacts 1008, 1108.

Figure 14:
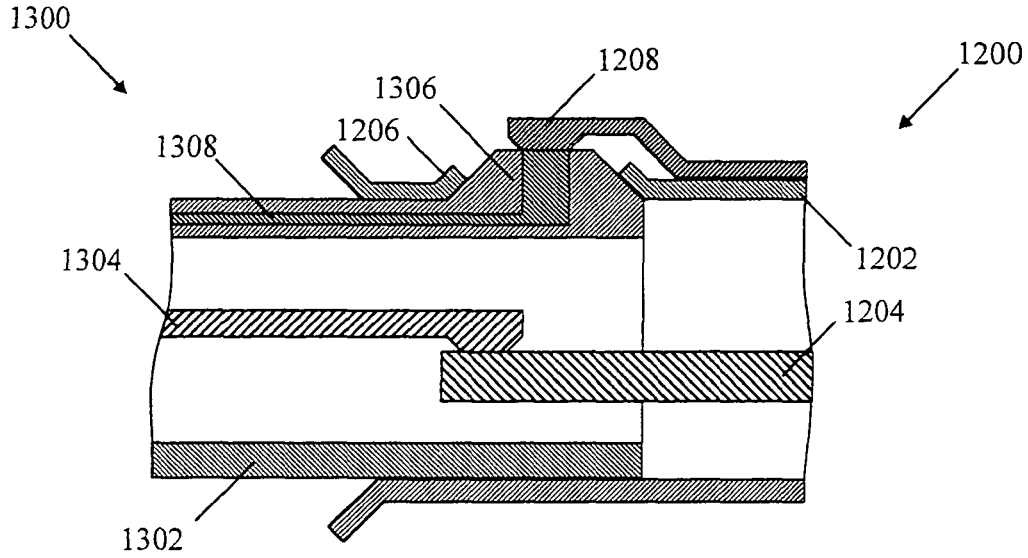
FIG. 14 is a cross section of a sixth embodiment of a male connector connected to a sixth embodiment of a female connector.

FIG. 14 is a cross section of a sixth embodiment of a male connector 1300 connected to a sixth embodiment of a female connector 1200. The female connector 1200 is similar to female connector 500. The male connector 1300 is similar to male connector 100, except that male connector 1300 has a conductor 1308 embedded within the housing 1302 and arranged to contact the conductor 1208 of the female connector 1208. The conductor 1308 of the male connector 1300 is exposed at an uppermost surface of the protrusion of the locking element 1306. The conductor 1208 of the female connector 1200 is arranged to contact the exposed part of the conductor 1308.

Figure 15:
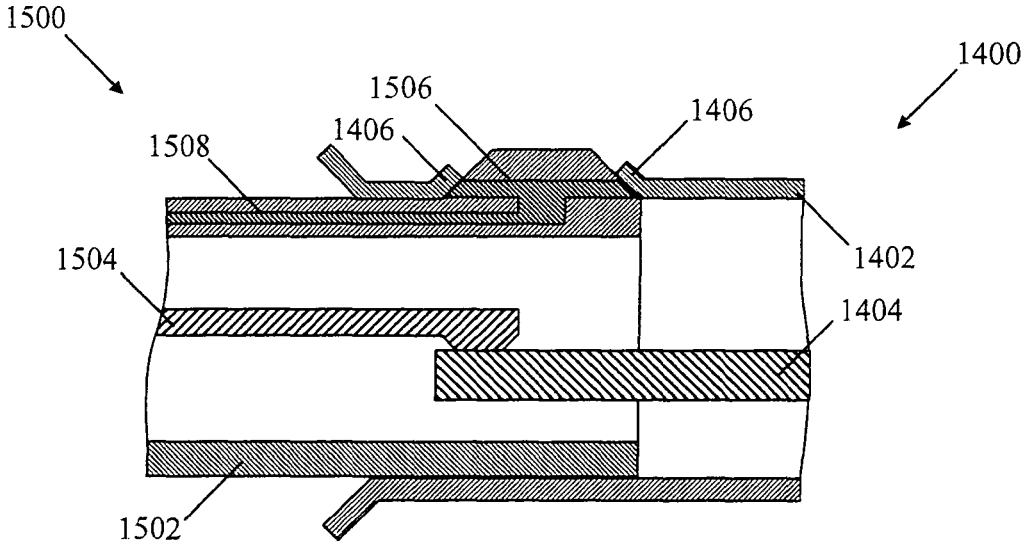
FIG. 15 is a cross section of a seventh embodiment of a male connector connected to a seventh embodiment of a female connector.

FIG. 15 is a cross section of a seventh embodiment of a male connector 1500 connected to a seventh embodiment of a female connector 1400. The female connector is similar to female connector 100. The male connector 1500 is similar to male connector 1300 except that the conductor 1508 is exposed at opposing side surfaces of the protrusion of the locking element 1506. The exposed parts of the conductor 1508 are arranged to connect electrically to the electrically-conductive parts of the housing 1402 of the female connector 1400 immediately surrounding the recessed part of the locking element 1406. The locking element 1406 may be arranged to protect a user's finger from coming into contact with the conductor 1508.

Figure 16:
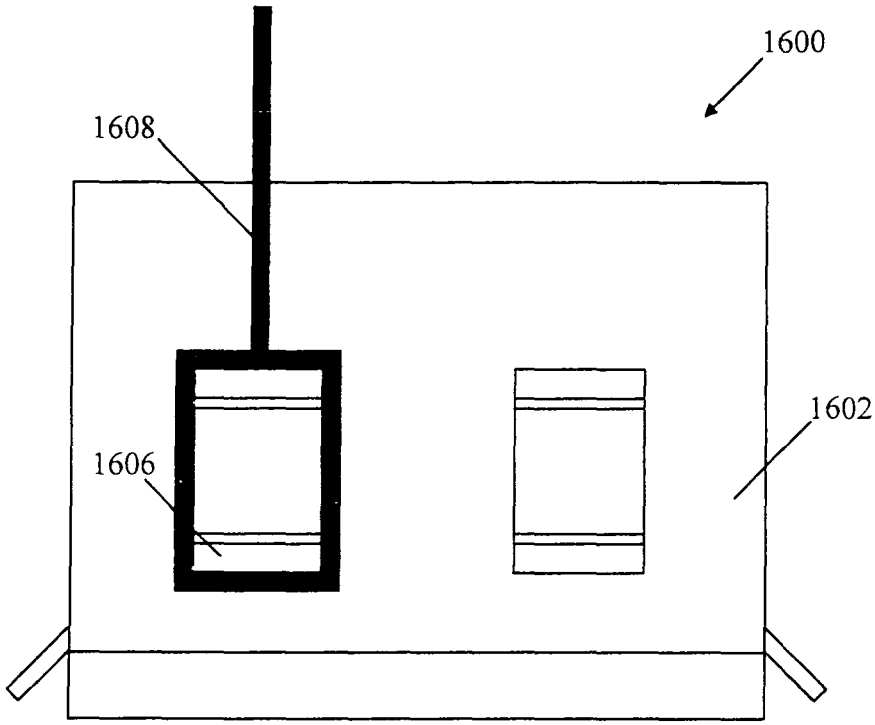
FIG. 16 is a plan view of an eighth embodiment of a female connector.

FIG. 16 is a plan view of an eighth embodiment of a female connector 1600 including a conductor 1608 which extends around a periphery of the locking element 1606. The housing of the female connector 1600 may be formed of an insulating material, e.g. plastic.

Figure 17:
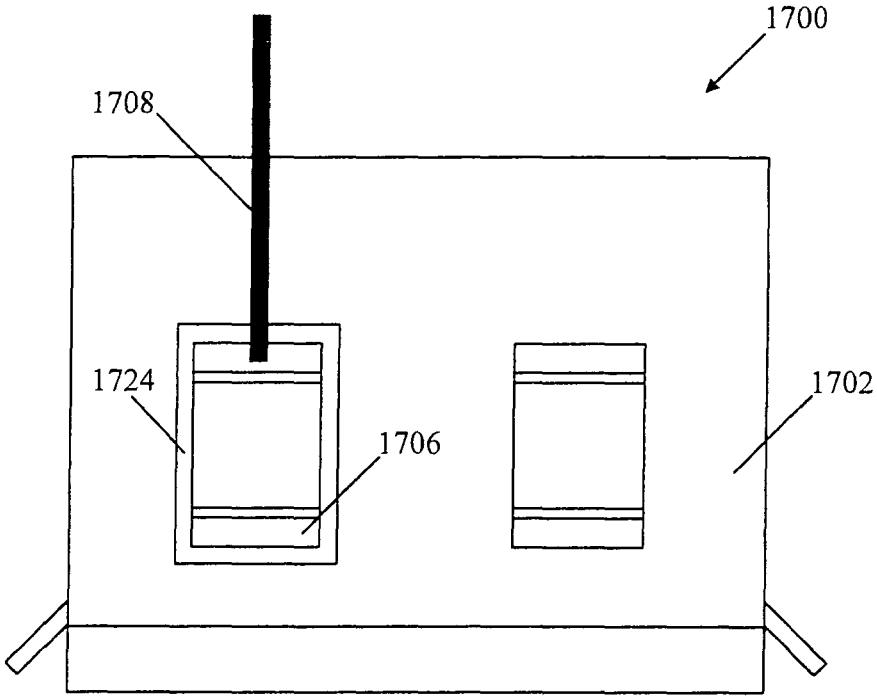
FIG. 17 is a plan view of a ninth embodiment of a female connector.

FIG. 17 is a plan view of a ninth embodiment of a female connector 1700 including a conductor 1708 which connects directly to the locking element 1706. The locking element 1706 is electrically insulated from the housing 1702 of the connector 1700 by insulating material 1724.

Figure 18:
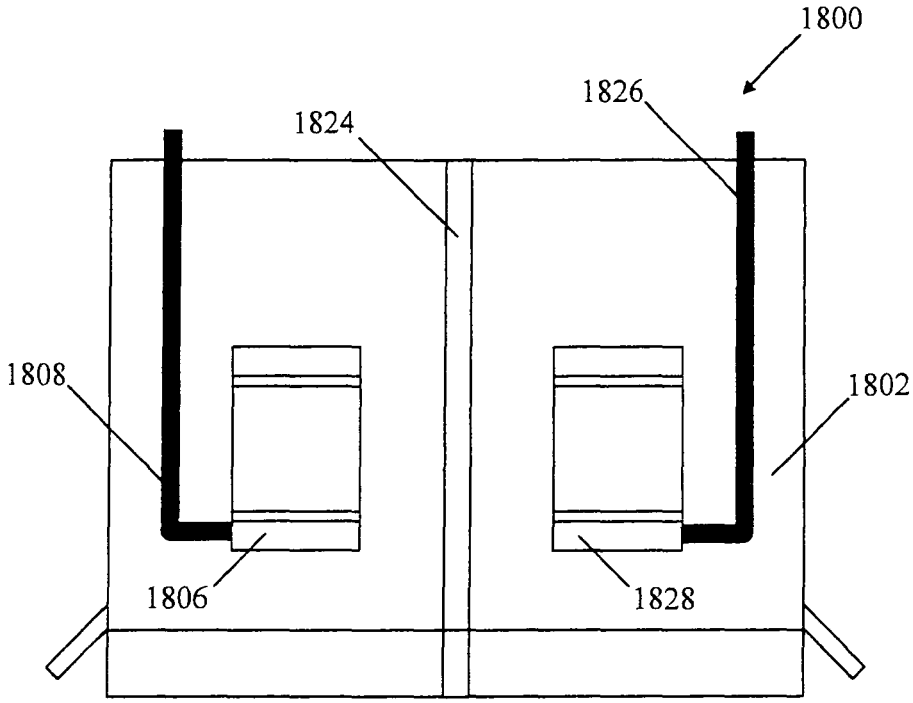
FIG. 18 is a plan view of a tenth embodiment of a female connector.

FIG. 18 is a plan view of a tenth embodiment of a female connector 1800. The female connector 1800 is similar to female connector 100 except that it also includes a second conductor 1826 connected to a second locking element 1828. The housing 1802 is split into two parts which are electrically insulated from one another by insulating material 1824. The female connector 1800 may be used with a male connector (not shown) which also has a second conductor attached to a second locking element. In this way, the connectors provide a third signal path, in addition to the one or more first signal paths and the second signal path.

Figure 19:
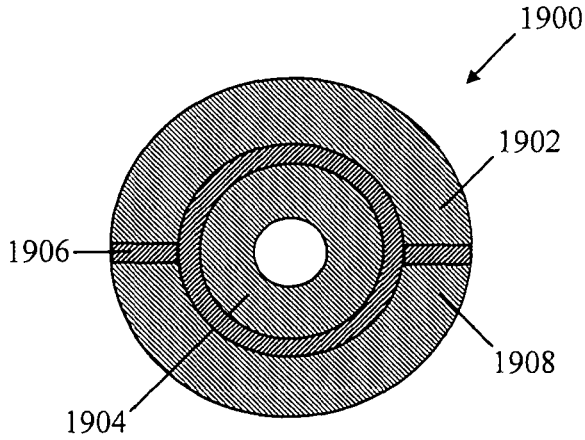
FIG. 19 is a cross section of an eleventh embodiment of a male connector.

FIG. 19 is a cross section of an eleventh embodiment of a male connector 1900, being a barrel jack. The male connector 1900 is similar to male connector 1000 except that the outer barrel contact is split into two contacts along its length rather than around its circumference. The male connector 1900 includes first and second outer barrel contacts 1902 and 1908, an inner barrel contact 1904, and insulating material 1904 insulating the contacts from one another.

It will be appreciated that the aforementioned circuitry may have other functions in addition to the mentioned functions, and that these functions may be performed by the same circuit. The contact between the connectors may be point contact, linear contact, area contact, curved contact etc. The connectors may conform to a USB standard, including the On-The-Go Supplement (revision 1.2) to the USB 2.0 specification. The connectors may conform to an audio jack standard. The recessed parts may be located on the male connectors.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

The invention claimed is:

1. A connector comprising:

a first contact configured to mate with a contact of a complementary connector, the first contact providing a first contact point of a first signal path for the transmission of electrical signals through the connector; and an electrically-conductive locking element of the connector configured to engage an electrically-conductive element on the complementary connector, the electrically-conductive locking element of the connector configured to provide a second contact point of a second signal path for the transmission of electrical signals through the connector, the electrically-conductive locking element of the connector comprising a protrusion or aperture configured to inter-engage with a complementary aperture or protrusion of the complementary connector; and a conductor in electrical communication with the electrically-conductive locking element of the connector, wherein the conductor is configured to act as a radio antenna by extending from the electrically-conductive locking element of the connector, and the conductor and the electrically-conductive locking element of the connector cooperate to provide the second signal path for the transmission of electrical signals through the connector.

2. The connector according to claim 1, wherein the aperture of the electrically conductive locking element of the connector is one of a protrusion for a recessed aperture part of the complementary connector or a recessed aperture part configured to engage a protrusion on the complementary connector.

3. The conductor according to claim 1 comprising a cable having one or more wires connected to the second contact point, the cable comprising a shield enclosing the one or more wires, the conductor being at least partially external to the shield.

4. The connector according to claim 1, wherein the conductor is configured for connection of the second signal path to a device associated with the connector.

5. The connector according to claim 1, comprising a plurality of electrically conductive locking elements of the connector configured to engage electrically-conductive elements on the complementary connector, each electrically-conductive locking element of the connector providing a contact point of a respective signal path for the transmission of electrical signals through the connector.

6. The connector according to claim 1, configured to conform to a USB standard.

7. The connector according to claim 1, configured to conform to an audio jack standard.

8. The connector according to claim 1, configured to provide power to an electronic device.

9. An electronic device comprising the connector according to claim 1.

10. A peripheral device comprising the connector according to claim 1.

11. A connector according to claim 1, wherein the electrically-conductive locking element is at least a part of a housing of the connector.

12. A complementary connector for the connector according to claim 1.

13. An electronic device according to claim 9, wherein the electronic device is a handportable multimedia device.

14. An electronic device according to claim 9, wherein the electronic device is configured to comprise radiotelephony functionality.

15. A peripheral device according to claim 10, wherein the peripheral device is a headset for transmitting audio to a user.

16. A method of using a connector, the connector comprising a first contact configured to mate with a contact of a complementary connector, the first contact providing a first contact point of a first signal path for the transmission of electrical signals through the connector; and an electrically-conductive locking element of the connector configured to engage an electrically-conductive element on the complementary connector, wherein the electrically-conductive locking element of the connector is configured to provide a second contact point of a second signal path for the transmission of electrical signals through the connector, the method comprising using the electrically-conductive locking element of the connector to provide a contact point of a second signal path for the transmission of electrical signals through the connector, and a conductor in electrical communication with the electrically-conductive locking element of the connector, wherein the conductor is configured to act as a radio antenna by extending from the locking element and the conductor and the electrically-conductive locking element of the connector cooperate to provide the second signal path for the transmission of electrical signals through the connector.

17. A connector comprising:

a first contact configured to mate with a contact of a complementary connector, the first contact configured to provide a first contact point of a first signal path for the transmission of electrical signals through the connector;

an electrically-conductive element of the connector configured to engage an electrically-conductive element on the complementary connector, the electrically-conductive element of the connector configured to provide a second contact point of a second signal path for the transmission of electrical signals through the connector, wherein the electrically-conductive element of the connector comprises one or more of a pad formed in a housing of the connector, a conductor embedded within the housing of the connector, two or more internal barrel contacts providing an internal connection through an internal barrel aperture, a locking element protrusion configured to expose at least a part of the electrically-conductive element of the connector, a periphery of a locking element, a locking element configured to connect directly to the electrically-conductive of the conductor and electrically insulated from the housing of the connector, and a contact configured to be electrically insulated from another contact; and a conductor in electrical communication with the electrically-conductive element of the connector, the conductor configured to act as a radio antenna by extending from the electrically-conductive element of the connector, and the conductor and the electrically-conductive element of the connector cooperate to provide the second signal path for the transmission of electrical signals through the connector.

18. A male barrel connector, the barrel of the male barrel connector comprising an aperture which extends within the male barrel connector from the tip of the barrel connector, the male barrel connector comprising:

an internal contact provided within the aperture and configured to mate with a contact of a female barrel connector, the internal contact providing a first contact point of a first signal path for the transmission of electrical signals through the male barrel connector; and at least one electrically-conductive element on an external face of the male barrel connector, the at least one electrically-conductive element on an external face of the male barrel connector configured to be electrically isolated from at least one other electrically-conductive element of the male barrel connector to provide for respective connector contact points of at least one further signal path for the transmission of electrical signals through the male barrel connector, and a conductor in electrical communication with the at least one electrically-conductive element on an external face of the male barrel connector, wherein the conductor is configured to act as a radio antenna by extending from the at least one electrically-conductive element on an external face of the male barrel connector, and the conductor and the at least one electrically-conductive element on an external face of the male barrel connector cooperate to provide at least one of the further signal paths for the transmission of electrical signals through the male barrel connector.

19. A female barrel connector configured to receive a male barrel connector according to claim 18 for electrical connection, the female barrel connector comprising:

a contact configured to be inserted into the aperture of the male barrel connector to provide a first signal path; and at least one electrically-conductive element of the female barrel connector configured to connect with at least one respective electrically-conductive element on the external face of the male barrel connector to provide at least one further signal path.

20. A female barrel connector according to claim 19, wherein the at least one electrically-conductive element of the female barrel connector is configured to provide connection of the radio antenna of the male barrel connector.

* * * * *